US005983041A

United States Patent [19]

Otaki et al.

[11] Patent Number: 5,983,041

[45] Date of Patent: Nov. 9, 1999

[54] IMAGE RECORDING APPARATUS HAVING A NEUTRALIZING DEVICE

[75] Inventors: Noboru Otaki; Yoshitatsu Okiyama; Shinichi Murakami; Masato Sakai; Koji Ida; Shuichiro Ogata; Hiroyuki Inoue; Syuiti Fujikura, all of Tokyo, Japan

[73] Assignee: Oki Data Corporation, Tokyo, Japan

[21] Appl. No.: 08/886,279

[22] Filed: Jul. 1, 1997

[30] Foreign Application Priority Data

Jul. 4, 1996 [JP] Japan ..... 8-175141

[51] Int. Cl.[6] ..... G03G 15/00; G03G 15/16

[52] U.S. Cl. ..... 399/45; 399/296

[58] Field of Search ..... 399/45, 296, 187, 399/190, 192

[56] References Cited

U.S. PATENT DOCUMENTS

| | | | |
|---|---|---|---|
| 4,468,113 | 8/1984 | Motohashi et al. | 399/45 |
| 4,560,268 | 12/1985 | Nishimura | 399/296 |
| 4,853,736 | 8/1989 | Goto et al. | 399/296 |
| 5,126,792 | 6/1992 | Iwata | 399/190 X |
| 5,614,998 | 3/1997 | Sanpe | 399/296 X |
| 5,729,808 | 3/1998 | Bisaiji | 399/296 |

*Primary Examiner*—Fred L. Braun

*Attorney, Agent, or Firm*—Akin, Gump Strauss, Hauer & Feld, L.L.P.

[57] ABSTRACT

An image recording apparatus includes a rotating photosensitive drum, a developing unit, a neutralizing device, and a transferring device. An electrostatic latent image is formed on a charged surface of the rotating photosensitive drum, the electrostatic latent image being developed by a developing unit and subsequently transferred by a transferring device to a print medium. The neutralizing device neutralizes the charged surface of the photosensitive drum at the point on the surface disposed downstream of the developing unit and upstream of the transferring device with respect to rotation of the photosensitive drum. A controller controls the neutralizing device according to characteristics of the print medium such as size, material, insulation, and transparency. The neutralizing device may be operated in different modes. For example, the neutralizing device may neutralize an entirety of the charged surface of the photosensitive drum only if the print medium is of a predetermined characteristic, i.e., an insulating sheet such as a transparent OHP sheet or may neutralize only selected parts of the charged surface of the photosensitive drum according to a width of the print medium.

19 Claims, 10 Drawing Sheets

SP BIAS POWER SUPPLY
DB BIAS POWER SUPPLY
CHARGING POWER SUPPLY
TRANSFER POWER SUPPLY
PRINT CONTROL-LER
MEMORY
52B
53B
54B
55B
58B
59B
52C
53C
54C
55C
58C
59C
52M
53M
54M
55M
58M
59M
52Y
53Y
54Y
55Y
58Y
59Y
NEUTRALIZING LAMP CONTROLLER
88B
88C
88M
88Y
100
CONTROLLER
51
INTERFACE SECTION
60
CHARGING POWER SUPPLY
NUETRA-LIZING POWER SUPPLY
SENSOR RECEIVER DRIVER
MOTOR DRIVE CIRCUIT
FIXING DEVICE DRIVER
56
57
66
62
61
70
71
86
63
64

IMAGE RECORDING APPARATUS HAVING A NEUTRALIZING DEVICE

BACKGROUND OF THE INVENTION

1. Technical Field of the Invention

The present invention relates to an image recording apparatus.

2. Description of Related Art

Image recording apparatuses such as an electrophotographic printer use an electrophotographic method. A photosensitive drum surface is uniformly charged by a charging device and light illuminates the charged surface to form an electrostatic latent image thereon. Then the electrostatic latent image is developed into a toner image by a developing device which deposits toner on the electrostatic latent image formed on the photosensitive drum. The toner image is then transferred to the print medium by a transferring device. The toner image transferred to the print medium is fixed by a fixing device.

FIG. 14 illustrates a general construction of a conventional image recording apparatus.

A charging roller 17 applies a negative voltage to the surface of a photosensitive drum 16 rotating in a direction shown by arrow A, so that the surface of the photosensitive drum 16 is negatively charged. An LED head 13 illuminates the surface of the photosensitive drum 16 to form an electrostatic latent image thereon.

Then, a developer 18 deposits negatively charged toner 10 to the photosensitive drum 16 to develop the electrostatic latent image into a toner image. When a print medium 37 is fed between the photosensitive drum 16 and a transfer roller 14, the transfer roller 14 receives a positive voltage so that the toner image is transferred to the print medium 37.

With the aforementioned conventional image recording apparatus, if the print medium 37 is a sheet made of an insulating material such as a transparent OHP (overhead projector) sheet, negative charges are apt to be stored on the insulating sheet. When the transparent sheet 37 passes between the photosensitive drum 16 and transfer roller 14, discharge takes place from the photosensitive drum 16 to the print medium 37. Therefore, a surface potential of the transparent medium 37 is negative.

The amount of negative charges increases since there is no path through which the negative charges stored on the surface of the transparent medium 37 can leak. As a result, the negative charges accumulates on the surface of the transparent medium 37 and the negative potential on the surface increases, being detrimental to effective transfer of the toner 10 to the print medium 37.

FIG. 15 illustrates the transfer process of the conventional image recording apparatus. Referring to FIG. 15, the width of the print medium 37 is narrower than the photosensitive drum 16 and transfer roller 14. When the high voltage is applied to the transfer roller 14, a transfer current Ia flows through the print medium 37 sandwiched between the transfer roller 14 and photosensitive drum 16. During the transferring process, an unwanted current Ib also flows directly from the transfer roller 14 to the photosensitive drum 16.

If the print medium 37 is thick, the impedance of the print medium 37 is high. Therefore, the transfer current Ia decreases and the unwanted current Ib increases by that amount with the result that the toner image 98 is transferred incompletely to the print medium. One way of increasing Ia is to increase the transfer voltage. However, changing the transfer voltage in accordance with the various widths of the print medium 37 is difficult and an increase in transfer voltage results in an increase in unwanted current Ib. An increased unwanted current Ib causes damages to the surface of the photosensitive drum 16.

SUMMARY OF THE INVENTION

An object of the present invention is to solve the drawbacks of the conventional image recording apparatus and to provide an image recording apparatus where the transfer quality is not affected by the characteristics such as size (width), material, transparency (OHP sheet and ordinary paper), insulation (resistance), and thickness of the print medium.

Another object of the invention is to provide an image recording apparatus where the photosensitive drum is not damaged during transfer operation.

An image recording apparatus includes a photosensitive drum, developing unit, transferring device, and neutralizing device. The photosensitive drum rotates about its rotational axis and has an electrostatic latent image formed on its charged surface. The developing device is disposed close to the photosensitive drum. The developing device performs a developing operation in which the electrostatic latent image is developed with toner into a toner image. The transferring device is disposed close to the photosensitive drum and downstream of the developing device with respect to rotation of the photosensitive drum, and transfers the toner image to a print medium. The neutralizing device neutralizes the charged surface of the photosensitive drum which has been subjected to the developing operation, the area being neutralized before the toner image is transferred by the transferring device to the print medium.

The neutralizing device may be operated in different modes. For example, the neutralizing device may neutralize an entirety of the charged surface of the photosensitive drum.

The neutralizing device may be operated to neutralize the entirety of the charged surface which has been subjected to developing operation only if the print medium is of a predetermined type, i.e., an insulating sheet such as a transparent OHP sheet.

The neutralizing device may neutralize selected parts of the charged surface of the photosensitive drum according to a width of the print medium.

The neutralizing device emits light that illuminates the selected parts of the longitudinal area to neutralize the charged surface. The neutralizing device may emit light to illuminate the charged surface of the photosensitive drum from behind the print medium when a leading edge of the print medium is brought into contact with the developed surface, the print medium blocking the light so that only the selected parts of the charged surface along the length of the photosensitive drum is illuminated by the light.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the present invention will be described in detail with reference to the drawings.

First Embodiment

Figure 1:
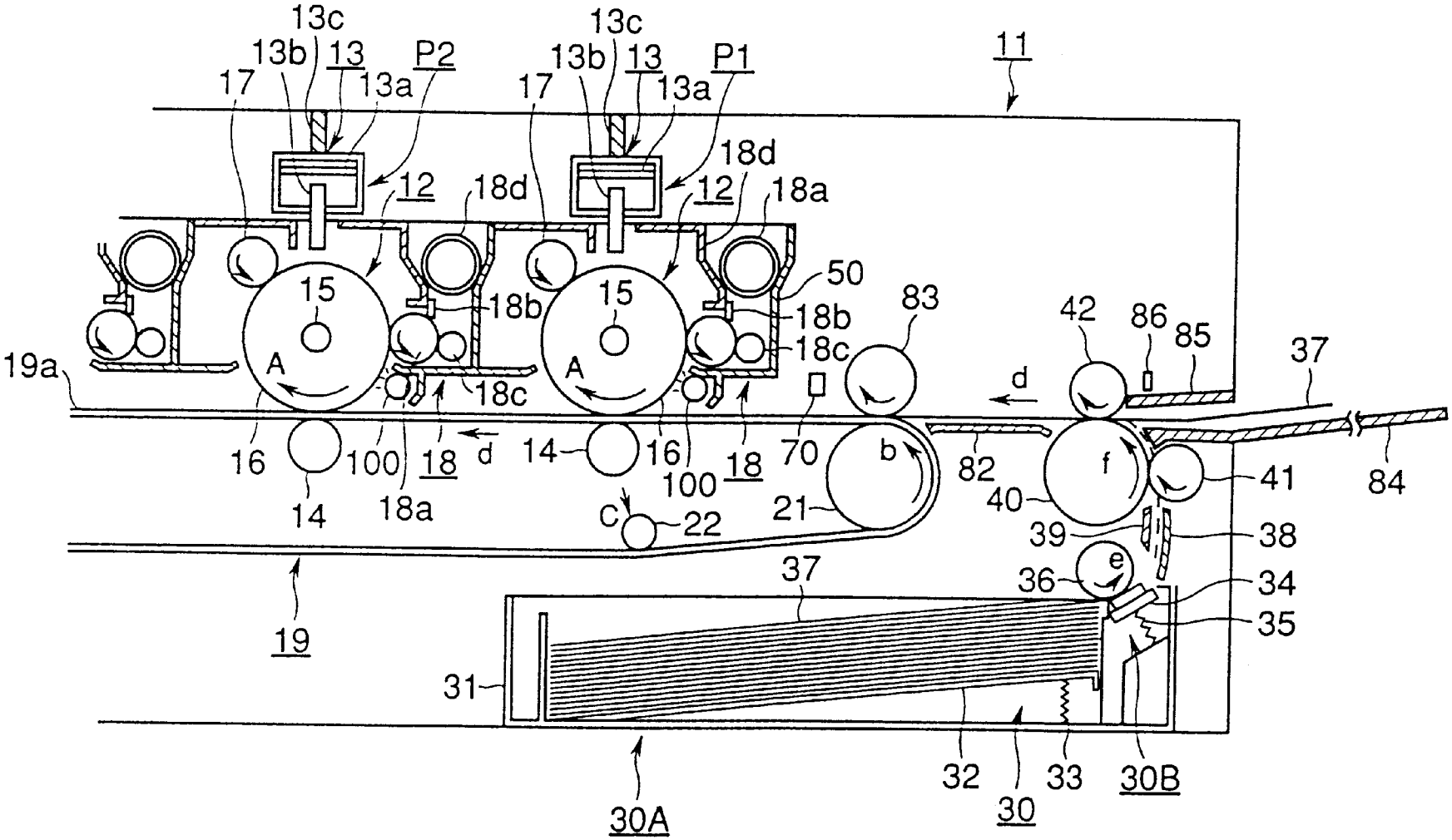
FIGS. 1 and 2 are first and second figures, illustrating a general construction of a color image recording apparatus according to a first embodiment.
Figure 2:
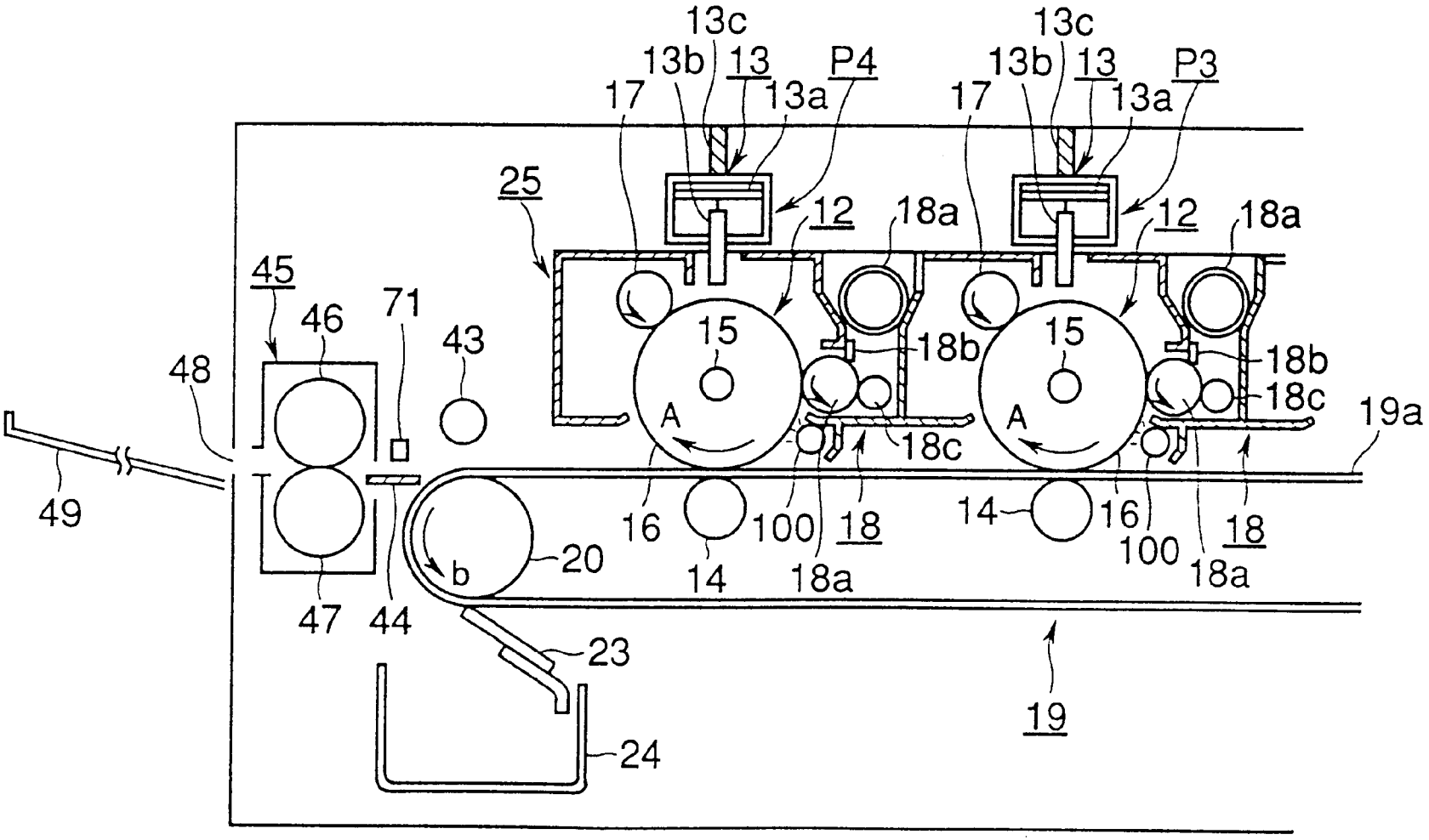

FIGS. 1 and 2 are first and second figures, illustrating a general construction of a color image recording apparatus according to a first embodiment. The first embodiment will be described with respect to a color image recording apparatus.

Overall Construction

Referring to FIGS. 1 and 2, a color image recording apparatus 11 includes first to fourth printing mechanisms P1–P4 that form a printing section, the printing mechanism being aligned in this order from upstream of the path of a print medium to downstream thereof. All of the printing mechanisms P1–P4 include LED type electrophotographic printing devices for yellow, magenta, cyan, and black, respectively. The printing mechanisms P1–P4 are of the same construction and therefore only the first printing mechanism P1 is described. Elements in the second to fourth printing mechanisms P2–P4 are given the same reference numerals as the first printing mechanism.

The first printing mechanism P1 includes an LED head 13, a transfer roller 14, and an image forming section 12. The LED head 13 illuminates the surface of a photosensitive drum 16 in accordance with image data to form an electrostatic latent image on the photosensitive drum surface. The transfer roller 14 transfers the toner image formed by the image forming section 12 to a print medium 37.

The image forming section 12 includes the photosensitive drum 16, a charging roller 17, a developing unit 18, and lamp 100. The developing unit 18 is upstream of the transfer roller 14 with respect to the rotation of the photosensitive drum 16.

The photosensitive drum 16 is rotated about a shaft 15 in a direction shown by arrow A. The charging roller 17 uniformly charges the surface of the photosensitive drum 16. The developing unit 18 operates to develop the electrostatic latent image with toner into a toner image. The lamp 100 illuminates the surface of the photosensitive drum 16 to substantially neutralize the negatively charged surface of the photosensitive drum 16. The image forming section 12 of the respective printing mechanism is housed in a corresponding case 50. The first to fourth printing mechanisms constitute a color image forming unit 25 as a whole.

The developing unit 18 includes a developing roller **18*a* made of semiconductive rubber, developing blade 18*b*, sponge roller 18*c* that supplies an appropriate amount of non-magnetic single component toner, (not shown) to the developing blade 18*b*, and toner tank 18*d* that holds toner therein. When the toner tank 18*d* runs out of toner, the tank 18** can be replaced.

The toner in the toner tank **18*d* is delivered to the developing blade 18*b* via the sponge roller 18*c* and is deposited by the blade 18*b* as a thin toner layer on the surface of the developing roller 18*a*. The toner is then strongly rubbed between the developing roller 18*a* and developing blade 18*b* so that the toner is charged by friction electricity. In the first embodiment, the toner is negatively charged by friction. The developing roller 18*a* rotates so that the toner deposited on the surface of the developing roller 18*a* is brought into contact with the surface of the photosensitive drum 16**.

The LED head 13 includes an LED array, not shown, circuit board **13*a* having driver ICs mounted thereon which drive the LED array, and rod lens array 13*b* that focuses the light emitted from the LED array on the surface of the photosensitive drum 16. The LED head 13 is urged by a spring 13*c* in a downward direction in FIGS. 1 and 2**.

The LED array illuminates the photosensitive drum 16 when yellow image data is received from a later described interface section, thereby forming an electrostatic latent image on the surface of the photosensitive drum 16.

Then, the toner is attracted to the electrostatic latent image by Coulomb force, forming a toner image. An endless carrier belt 19 is sandwiched between the photosensitive drums 16 and transfer rollers 14 of the print mechanisms P1–P4 and runs therebetween. The toner tanks **18*d* of the developing devices 18 of the print mechanisms P1–P4** hold yellow, magenta, cyan, and black toner, respectively.

The printing mechanisms P1–P4 receive a yellow image signal, magenta image signal, cyan image signal, and black image signal, respectively.

The carrier belt 19 is made of a high resistance semiconductive plastic film and is mounted about drive roller 20, driven roller 21, and tension roller 22. The resistance of the carrier belt 19 is selected so that the print medium 37 is sufficiently attracted by Coulomb force to the carrier belt 19 and yet the residual static electricity on the carrier belt 19 may be readily removed when the print medium 37 is separated from the carrier belt 19.

The drive roller 20 is connected to a motor, not shown, and is rotated by the motor in a direction shown by arrow b. The driven roller 21 is also rotated in the direction shown by arrow b. The carrier belt 19 is held taut by tension roller 22 urged by the spring, not shown, in a direction shown by arrow c. The upper half 19*a* of the carrier belt 19 runs between the photosensitive drums 16 and transfer rollers 14 of the respective printing mechanisms P1–P4, transporting the print medium 37 at a predetermined speed.

A cleaning blade 23 is pressed against the carrier belt 19. The cleaning blade 23 is made of a material such as flexible rubber, plastics, or the like.

The tip of the cleaning blade 23 pressed to the carrier belt 19 scratches the residual toner on the surface of the carrier belt 19 and the scratched toner falls into the waste toner tank.

A paper feeding mechanism 30 is disposed at the lower right-hand side of the color image recording apparatus 11 shown in FIG. 1. The paper feeding mechanism 30 includes a paper cassette 30A, hopping mechanism 30B, feeding roller 40, and first and second rollers 41 and 42 pressed to the feeding roller 40. The paper cassette 30A includes a paper tray 31, push-up plate 32, and urging means 33. The hopping mechanism 30B includes a separator 34, spring 35, and hopping roller 36. The separator 34 is pressed by the spring 35 against the hopping roller 36, defining a separation area between the separator 34 and the hopping roller 36.

The urging means 33 urges the print paper 37 in the paper tray 31 via the push-up plate 32 against the hopping roller 36. When the hopping roller 36 is rotated by a motor, not shown, in a direction shown by arrow e, the print medium 37 sandwiched between the hopping roller 36 and the separator 34 is advanced while being separated from the rest of stacked sheets of paper. The print medium 37 is then guided between guides 38 and 39 so that it is pulled in between the feeding roller 40 and first roller 41.

When the feeding roller 40 is rotated by a motor, not shown, in a direction shown by arrow f, the print medium 37 is transported by the feeding roller 40 and the second roller 42 in a direction shown by arrow d, being guided by a guide 82, and then pulled in between a charging roller 83 and the carrier belt 19.

The charging roller 83 is pressed against the driven roller 21 via the carrier belt and charges the print medium 37 delivered by the paper feeding mechanism 30, so that the print medium 37 is attracted to the carrier belt 19 by Coulomb force. For this purpose, the charging roller 83 is made of a semiconductive rubber material having a high electrical resistance. A photosensor 70 is disposed between the charging roller 83 and first printing mechanism P1 over the path in which the print medium 37 is transported, and detects the leading edge of the print medium 37.

A tray 84 is a manual feeding mechanism which allows the user to manually insert the print medium 37 into a space between the tray 84 and guide 85. A photosensor 86 detects the manually fed print medium 37.

A neutralizing device 43 is above and close to the drive roller 20, opposing the upper part 19*a* of the carrier belt 19. The neutralizing device 43 neutralizes the charges on the print medium 37 transported by the carrier belt 19, so that the print medium 37 can be smoothly separated from the carrier belt 19. A guide 44 and fixing device 45 are disposed at the left-hand side of the neutralizing device 43. A photosensor 71 is disposed above a guide 44 between the fixing device 45 and the neutralizing device 43 and detects the trailing edge of the print medium 37 guided by the guide 44 into the fixing device 45.

The fixing device 45 fixes the toner image which has been transferred to the print medium 37. For this purpose, the fixing device 45 includes a heat roller 46 for fusing the toner on the print medium 37, and a pressure roller 47 for pressing the print medium 37 against the heat roller 46.

A paper exit 48 is at the left-hand side (downstream of the paper path) of the fixing device 45 and an exit stacker 49 is located at the outside of the paper exit 48. The print medium 37 on which an image has been printed is ejected to the paper exit 48 after the toner image has been fixed.

Control Circuit

Figure 3:
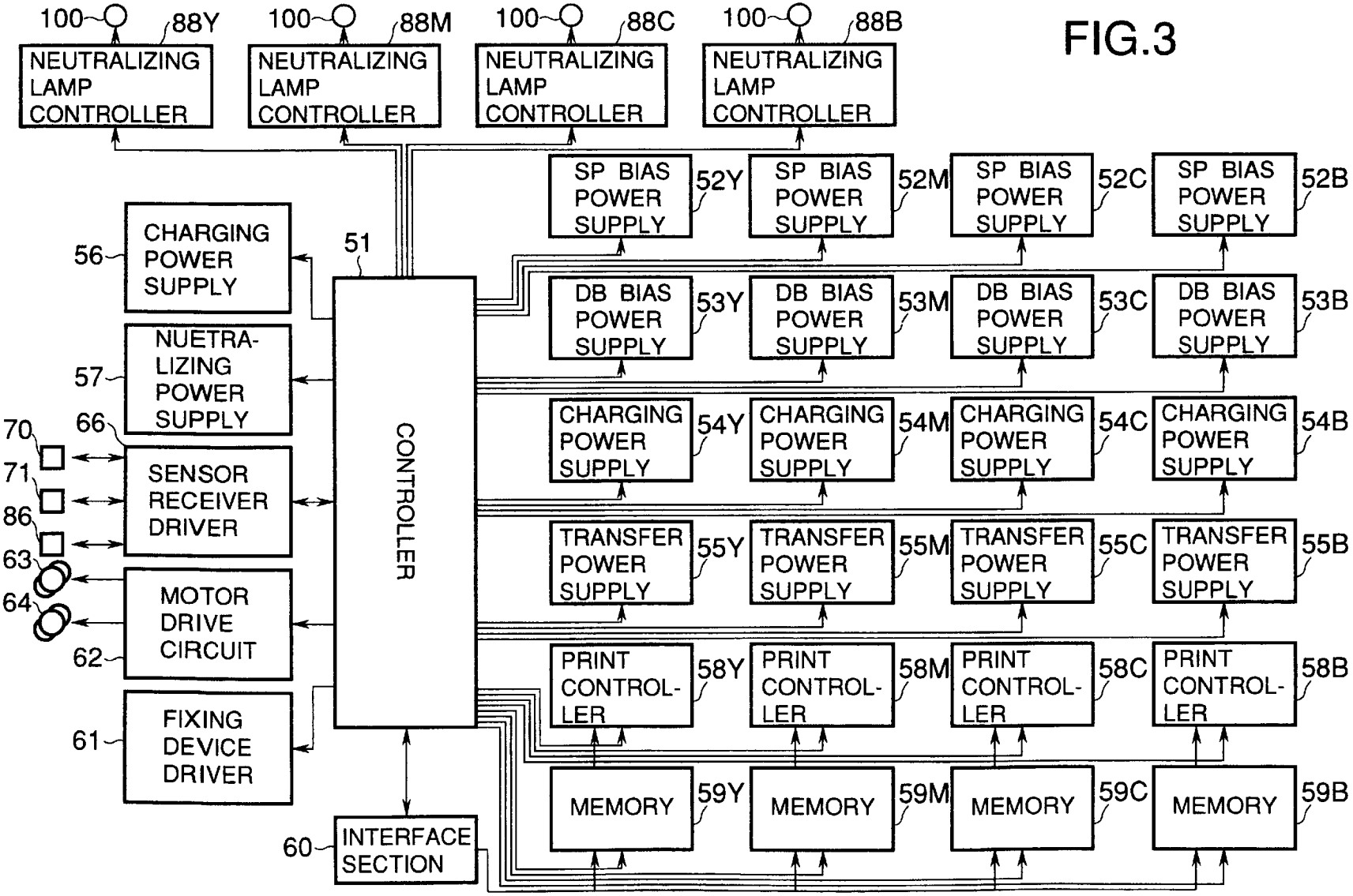
FIG. 3 is a block diagram showing a controller for a color image recording apparatus according to the first embodiment.

The control circuit of the color image recording apparatus of the aforementioned construction will now be described. FIG. 3 is a block diagram showing a controller for the aforementioned color image recording apparatus.

A controller 51 takes the form of, for example, a microprocessor and controls the entire operation of the color image recording apparatus 11 shown in FIGS. 1 and 2. The controller 51 is connected to SP bias power supplies 52Y, 52M, 52C, and 52B, DB bias power supplies 53Y, 53M, 53C and 53B, charging power supplies 54Y, 54M, 54C and 54B, and transfer power supplies 55Y, 55M, 55C, and 55B. The SP bias power supplies 52Y, 52M, 52C, and 52B apply a bias voltage to the sponge rollers 18*c* of the respective developing units of the first to fourth printing mechanisms P1–P4, respectively. The DB bias power supplies 53Y, 53M, 53C and 53B apply voltages to the developing rollers 18*a* of the first to fourth printing mechanism P1–P4, respectively. The charging power supplies 54Y, 54M, 54C and 54B apply bias voltages to the respective charging rollers 17 of the first to fourth printing mechanisms P1–P4, respectively. The transfer power supplies 55Y, 55M, 55C, and 55B apply voltages to the transfer rolLers 14 of the first to fourth printing mechanisms P1–P4, respectively.

The SP bias supplies, DB bias power supplies, charging power supplies, and transfer power supplies are controlled to turn on and off, and their output voltages may be controllably changed.

The controller 51 is also connected to a charging power supply 56 that applies a charging voltage to the charging roller 83 and the controller 51 is connected to a neutralizing power supply 57 that applies a high voltage to the neutralizing device 43 for neutralization of the print medium 37. The driven roller 21 is grounded so that the potential difference between the driven roller 21 and the charging roller 83 generates a Coulomb force by which the print medium 37 is attracted to the carrier belt 19.

The controller 51 controls the turn-on and turn-off operations of the SP bias supplies 52Y, 52M, 52C, and 52B, DB bias power supplies 53Y, 53M, 53C, 53B, charging power suppLies 54Y, 54M, 54C, and 54B, and transfer power supplies 55Y, 55M, 55C, and 55B.

The controller 51 is further connected to print controllers 58Y, 58M, 58C, and 58B which control the printing mechanisms P1–P4, respectively. The respective print controllers 58Y, 58M, 58C, and 58B receive a yellow image signal, magenta image signal, cyan image signal, and black image signal from memories 59Y, 59M, 59C, and 59B, respectively, and send the received color image signals to the corresponding LED heads 13 so that the LED array of each LED head illuminates a corresponding photosensitive drum 16 to form an electrostatic latent image on the surface of the photosensitive drum 16.

For this purpose, an interface section 60 separates the color signal received from an external device, for example, the host computer, not shown, into the yellow image signal, magenta image signal, cyan image signal, and black image signal, and stores these color image signals into the memories 59Y, 59M, 59C, and 59B, respectively.

The fixing device driver 61 controls the heater, not shown, in the heat roller 46 to cycle on and off so that the heat roller 46 in the fixing device 45 is maintained at a predetermined temperature. A motor drive circuit 62 drives a motor 63 that rotates the hopping roller 36. The motor driver circuit 62 also drives a motor 64. The photosensitive drums 16, charging rollers 17, developing rollers 18*a*, sponge rollers 18*c*, transfer rollers 14 of the printing mechanisms P1–P4, drive roller 20, and heat roller 46 are drivingly connected via gears or belts, not shown, so that they are driven in rotation by the motor 64.

The sensor receiver/driver 66 controls the photosensitive sensors 70, 71, and 86 to output waveform signals to the controller 51. Neutralizing lamp controllers 88Y, 88M, 88C, and 88B control the neutralization lamps 100 to turn on and off in response to commands from the controller 51, respectively. The neutralization lamp 100 is turned on if the print medium 37 is a transparent sheet and turned off if the print medium 37 is ordinary paper.

The operation of the coLor image recording apparatus 11 of the aforementioned construction will now be described.

Initialization of the Apparatus

Upon power up of the color image recording apparatus 11, the controller 51 performs initial setup, and then drives the fixing device driver 61 so that the heat roller 46 in the fixing device 45 is heated to a predetermined temperature and maintained at the predetermined temperature.

When the heat roller 46 reaches the predetermined temperature, the controller 51 controls the motor drive circuit 62 to drive the motor 64 to run, which drives the drive roller 20 in rotation so that the carrier belt 19 runs in the direction shown by arrow d. When the carrier belt 19 has run slightly more than one complete track, the motor 64 is stopped so as to stop the carrier belt 19. Thus, paper particles and residual toner on the carrier belt 19 are scratched off by the cleaning blade 23 into the waste toner tank 24.

When the color image recording apparatus 11 has been initialized, the interface section 60 enters standby condition waiting for color image signals from the external device.

When the interface section 60 receives the color image signals, the controller 51 outputs commands to the interface section 60 and memories 59Y, 59M, 59C, and 59B. In response to the command, the interface section 60 separates the received color image data into the respective color image signals and stores yellow, magenta, cyan, and black image signals into the memories 59Y, 59M, 59C, and 59B, respectively. The respective memories 59Y, 59M, 59C and 59B are adapted to store an amount of the data of the respective color image signals for one page of the print medium 37 to be printed.

Paper Feeding/Image Recording Operation

The operation will be described where the print medium 37 in the paper feeding mechanism is fed into the printing mechanisms and an image is printed on the print medium 37. The print medium 37 in the paper feeding mechanism 30 is assumed to be a transparent sheet for OHP.

The controller 51 controls the motor drive circuit 62 to drive the motor 63 so that the feeding roller 36 runs in the direction shown by arrow e. When the feeding roller 36 rotates, the separator 34 and feeding roller 36 feed the print medium 37 in the tray 31 so that only one page of the print medium 37 is sent out from the tray 31. The print medium 37 is then guided between the guides 38 and 39 till the leading edge of the print medium 37 abuts the feeding roller 40 and first roller 41 and the print medium 37 is further advanced slightly.

As a result, the print medium 37 flexes with its leading edge abutting the feeding roller 40 and first roller 41 so that the flexture removes the skew. Then, the controller 51 controls the motor drive circuit 62 to drive the motor 64, so that the photosensitive drums, charging rollers 17, developing rollers 18*a*, sponge rollers 18*c*, transfer rollers 14, drive rollers 20 of the printing mechanisms P1–P4, feeding roller 40, and heat roller 46 are driven in rotation.

When the feeding roller 40 is rotated in the direction of arrow f, the print medium 37 is transported by the first and second rollers 41 and 42 and guided by the guide 82. As a result, the leading edge of the print medium 37 is pulled in between the charging roller 83 and carrier belt 19. The leading edge of the print medium 37 is attracted to the carrier belt 19 by Coulomb force generated between the charging roller 83 and driven roller 21.

The further rotation of the feeding roller 40 allows the print medium 37 to be transported in the direction shown by arrow d, the print medium 37 remaining attracted to the carrier belt 19.

The controller 51 controls the sensor receiver/driver 66 to drive the photosensor 70 so that the photosensor 70 detects the leading edge of the print medium 37. The photosensor 70 is of an interrupter type. When the print medium traverses the light path of the photosensor 70, the photosensor 70 receives a less amount of light, thereby detecting the leading edge of the print medium 37.

When the trailing edge of the print medium 37 leaves the separator 34, the controller 51 controls the motor drive circuit 62 to stop the motor 63. Since the print medium 37 is assumed to be a transparent sheet such as an OHP sheet in this description, the output of the photosensor 70 indicates that the print medium is a transparent sheet. In the present embodiment, the controller 51 checks the output of the photosensor 70 to determine whether the print medium is a transparent sheet, and stores the result.

Operation of First Printing Mechanism

When the photosensor 70 detects the leading edge of the print medium 37, the controller 51 controls the charging power supplies 54Y, 54M, 54C, and 54B and DB bias power supplies 53Y, 53M, 53C, and 53B, and SP bias power supplies 52Y, 52M, 52C, and 53B to turn on, so that the charging rollers 17, developing rollers 18*a*, and sponge rollers 18*c* receive the corresponding voltages, respectively. The present embodiment assumes that the toner is negatively charged and therefore the charging rollers 17, developing rollers 18*a*, and sponge rollers receive −1350 volts, −300 volts, and −450 volts, respectively. The surfaces of the photosensitive drums 16 are charged at −800 volts by the charging roller 17.

In this manner, in the respective printing mechanisms P1–P4, the surfaces of the respective photosensitive drums 16 are uniformly charged by the corresponding charging rollers 17, respectively and the sponge rollers 18*c* and developing rollers 18*a* receive high voltages, respectively, so that the toner is charged.

The controller 51 outputs a command to the memory 59Y to read the yellow image signal for one line to be printed from the memory 59Y, and sends this yellow image signal to the print controller 58Y. In response to a command from the controller 51, the print controller 58Y converts the yellow image signal received from the memory 59Y into data that can be handled by the LED head 13 of the first printing mechanism P1, and then sends the converted data to the LED head 13.

The LED array of the LED head 13 of the first printing mechanism P1 emits light in accordance with the yellow image signal, so that an electrostatic latent image for one line corresponding to the yellow image signal is formed on the surface of the photosensitive drum 16 uniformly charged to −800 volts. The potential of the electrostatic latent image is nearly zero volts.

In this manner, an electrostatic latent image is formed by the yellow image data which is read line by line from the memory 59Y. When the memory 59Y has outputted the yellow image data for one page, the illumination by the LED array completes. Then, the developing roller 18*a* generates a Coulomb force which attracts the toner to the surface of the photosensitive drum 16 on which the electrostatic latent image is formed. As the photosensitive drum 16 rotates, the electrostatic latent image is developed line by line with the yellow toner into a complete yellow toner image for on page.

When the leading edge of the print medium 37 has reached between the photosensitive drum 16 and the transfer roller 14 of the first printing mechanism P1, the controller 51 controls the neutralizing lamp controller 88Y so that the neutralization lamp 100 illuminates the surface of the photosensitive drum 16, and controls the transfer power supply 55Y to turn on.

As a result, the transfer power supply 55Y applies a transfer voltage of +1500 volts to the transfer roller 14 so that the yellow toner image on the photosensitive drum 16 is transferred line by line to the print medium 37 as the photosensitive drum 16 rotates till the toner image for one page has been transferred to the print medium 37. In this manner, the first printing mechanism P1 completes the transfer of the yellow toner image to the print medium 37.

In this case, the lamp 100 illuminates the surface of the photosensitive drum 16 to bring the potential of the surface of the photosensitive drum 16 to nearly zero volts after the electrostatic latent image has been developed. Thus, a discharge will not take place between the surface of the photosensitive drum 16 and the surface of the print medium 37 when the print medium 37 passes between the photosensitive drum 16 and the transfer roller 14. This prevents the surface of the print medium 37 from having a negative potential.

As a result, the toner is sufficiently attracted to the print medium 37, preventing poor transfer performance.

When the trailing edge of the print medium 37 is pulled in between the photosensitive drum 16 and transfer roller 14, the controller 51 controls the neutralizing lamp controller 88Y to turn off the lamp 100 and switches off the SP bias power supply 52Y, DB bias power supply 53Y, charging power supply 54Y, and transfer power supply 55Y.

In the first embodiment, deposition and recovery of toner are simultaneously performed during developing process. For this purpose, non-magnetic single-component toner is used, and the developing roller 18*a* is resilient and electrically conductive and in light contact with the photosensitive drum 16 via a thin layer of toner. The developing roller 18*a* deposits the toner onto the electrostatic latent image formed on the photosensitive drum 16 and simultaneously attracts the residual toner on the photosensitive drum 16 by a strong electric field so that the residual toner is recovered to the surface of the developing roller 18*a*. The recovered toner is recirculated into the toner container, not shown, of the developing unit 18 for reuse.

Operation of Second Printing Mechanism

The carrier belt 19 continuously runs so that the print medium 37 is transported from the first printing mechanism P1 toward the second printing mechanism P2 where the magenta toner image is transferred to the print medium 37.

The controller 51 outputs a command to the memory 59M so that the memory 59M outputs the magenta image signal for one line to be printed to the print controller 58M. The print controller 58M converts the magenta image signal into data which can be handled by the second printing mechanism P2, and sends the converted data to the LED head 13 of the second printing mechanism P2.

Then, the LED array of the LED head 13 of the second printing mechanism P2 emits light in accordance with the magenta image signal. The light emitting diodes illuminate the photosensitive drum 16 to form an electrostatic latent image for one line of the magenta image signal on the surface of the photosensitive drum 16.

In this manner, an electrostatic latent image is formed on a line-by-line basis in accordance with the magenta image signal from the memory 59M and the exposure is terminated when an electrostatic latent image for one page has been formed. Then, the charged developing roller 18*a* deposits the magenta toner by Coulomb force to the surface of the photosensitive drum 16 on which the electrostatic latent image has been formed. Thus, as the photosensitive drum 16 rotates, each line of the electrostatic latent image is successively developed with the magenta toner into a magenta toner image.

When the leading edge of the print medium 37 reaches between the photosensitive drum 16 and transfer roller 14 of the second printing mechanism P2, the controller 51 turns on the transfer power supply 55M of the second printing mechanism P2, and controls the neutralizing lamp controller 88M to turn on the neutralization lamp 100 so that the lamp 100 illuminates the developed surface of the photosensitive drum 16.

The transfer power supply 55M applies a transfer voltage of +1500 volts to the transfer roller 14 so that the magenta toner image on the photosensitive drum 16 is transferred to the print medium 37 on a line-by-line basis. As the photosensitive drum 16 rotates, the magenta toner image is transferred line after line so that the magenta toner image for one page is transferred. In this manner, the second printing mechanism P2 completes the transfer operation of the magenta toner image to the printing medium 37.

Then, the print medium 37 is transported from the second printing mechanism P2 to the third printing mechanism P3 which transfers the cyan toner image to the print medium 37.

After the cyan toner image has been transferred to the print medium 37, the print medium 37 is transported from the third printing mechanism P3 to the fourth printing mechanism P4 which transfers the black toner image to the print medium 37.

As described above, the toner images of the respective colors are transferred to the print medium 37 one over the other into a full color image. Subsequently, the carrier belt 19 transports the print medium 37 to the neutralizing device 43. The controller 51 controls the neutralizing power supply 57 to drive the neutralizing device 43. The neutralizing device 43 neutralizes the charges on the print medium 37, so that the print medium 37 easily separates from the carrier belt 19. The print medium 37 leaves the carrier belt 19 when the print medium 37 passes over the drive roller 20, and is guided by the guide 44 to the fixing device 45. When the print medium 37 is transported past the neutralizing device 43, the controller 51 turns off the neutralizing power supply 57.

The heat roller 46 of the fixing device 45 has been heated to a predetermined temperature required for normal fixing operation before the print medium 37 arrives at the fixing device 45, and the full color toner image on the print medium 37 is fixed when the print medium 37 passes between the heat roller 46 and the pressure roller 47 in press contact with the heat roller 46. Upon completion of the fixing operation, the print medium 37 is ejected to the exit stacker 49. When the photosensor 71 detects the trailing edge of the print medium 37, the controller 51 is informed by the sensor receiver/driver 66 that the print medium 37 has been ejected.

When the print medium 37 has been ejected from the image recording apparatus 11, the controller 51 turns off the motor drive circuit 62, so that the motor 64 stops.

After the second to fourth printing mechanisms P2–P4 have transferred the toner images of the respective colors for one page, the controller 51 turns off the neutralizing lamp controllers 88M, 88C, and 88B, SP bias power supplies 52M, 52C, and 52B, DB bias power supplies 53M, 53C, and 53B, charging power supplies 54M, 54C, and 54B, and transfer power supplies 55M, 55C, and 55B.

Neutralizing the entirety of a developed surface of the photosensitive drum is particularly effective in transferring an developed image to a transparent insulating sheet such as an OHP sheet.

It is needless to say that a color image can also be printed when the print medium 37 is manually inserted through the manual insertion tray 84.

When the user feeds the print medium 37 into the manual insertion tray 84, the photosensor 86 detects the print medium 37. In response to the detection of the print medium 37, the controller 51 controls the motor drive circuit 62 to drive the motor 64 so that the feeding rollers 40, photosensitive drums 16, charging rollers 17 of the first to fourth printing mechanisms P1–P4, drive roller 20, and heat roller 46 are driven in rotation. The controller 51 also controls the charging power supply 56 in order to charge the attraction roller 83.

Since the feeding roller 40 is rotated in the direction shown by arrow f, the print medium 37 inserted through the manual insertion tray 84 is transported by the feeding roller 40 and second roller 42 and guided by the guide 82 toward the charging roller 83 and carrier belt 19.

The leading edge of the print medium 37 is attracted to the carrier belt 19 due to the Coulomb force generated between the charging roller 83 and driven roller 21. The further rotation of the feeding roller 40 allows the print medium 37 to be transported in the direction shown by arrow d, the print medium remaining attracted to the carrier 19. Then, the photosensor 70 detects the leading edge of the print medium 37 and informs the controller 51 of the detection of the print medium 37.

The operation of the color image recording apparatus 11 when the print medium 37 is manually inserted is the same as when the print medium 37 is fed automatically from the paper cassette 30A. Therefore, the description of the operation when the print medium 37 is manually inserted is omitted.

The controller 51 does not turn on the lamp 100 if the print medium 37 is ordinary paper. Thus, the neutralization lamp 100 does not illuminate the surface of the photosensitive drum 16, allowing the photosensitive drum 16 to be exposed to light less frequently. Exposing the photosensitive drum to light less frequently suppresses deterioration of the photosensitive drum.

If the print medium 37 is a transparent sheet used for an overhead projector, the neutralization lamp 100 illuminates the substantially entire surface of the photosensitive drum 16 with the result that the non-image area on the charged surface is discharged to a surface potential of about zero volts. This reduces the negative charges, so that a less amount of current is required to flow between the photosensitive drum and the transfer roller 14 in order to generate positive charges for transfer operation. Therefore, the current that flows in the non-image area may be reduced and transfer current can be increased accordingly, yielding good transfer result.

While the LED head 13 is used as exposure means, other means such as a laser or liquid crystal shutter may also be used in place of the LED head 13. Although, the output of the photosensor 70 is checked to determine whether the print medium 37 is an insulating sheet, data indicating that the print medium 37 is an insulating sheet may be inputted from the operating panel, not shown, and the inputted data is sent to the controller 51.

Although the first to fourth printing mechanisms P1–P4 are of separate construction, they may be assembled in a unitary construction.

In the first embodiment, although an insulating sheet has been described with respect to a transparent OHP sheet, an opaque insulating sheet may also be used. When an opaque insulating sheet is used, a device is added to the apparatus in order to run a current through the sheet. The resistance of the print medium may be determined on the basis of the current through the sheet, so that the controller 51 determines the characteristic of the sheet. This construction serves to determine insulation of the sheet.

Second Embodiment

Figure 4:
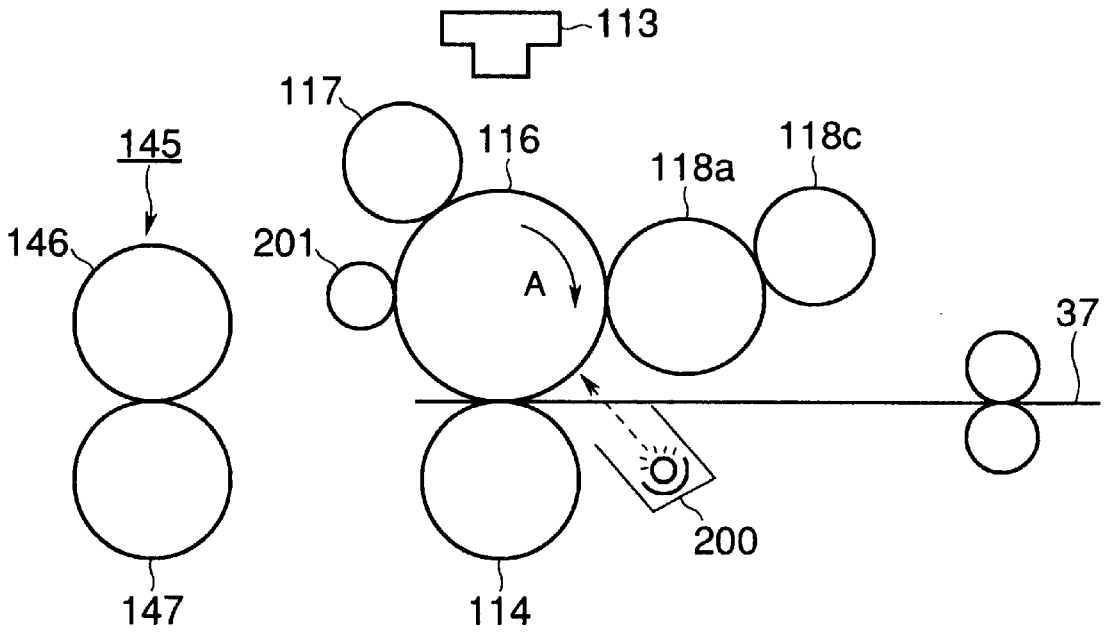
FIG. 4 illustrates a general construction of an image recording apparatus according to a second embodiment.
Figure 5:
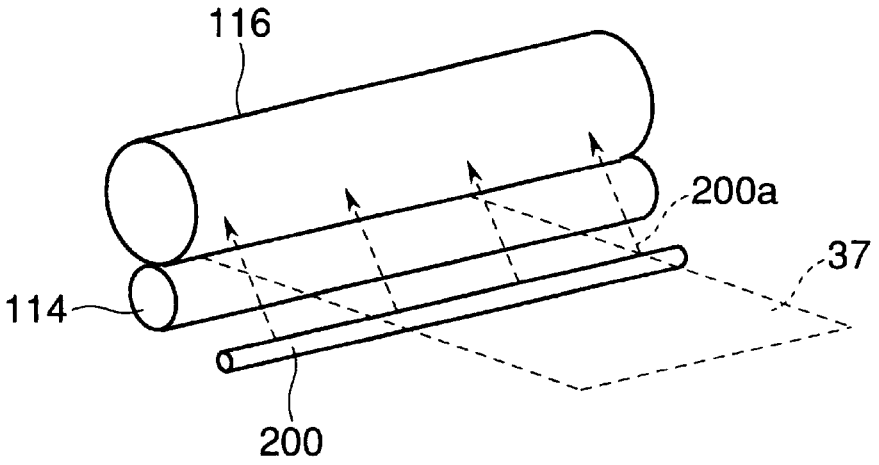
FIG. 5 is a perspective view of a relevant portion of the image recording apparatus according to the second embodiment.

FIG. 4 illustrates a general construction of an image recording apparatus according to a second embodiment of the invention. The second embodiment may be applicable to both a monochromatic image recording apparatus and color image recording apparatus. FIG. 5 is a perspective view of a relevant portion of the image recording apparatus according to the second embodiment.

Reference numerals 118*c* and 145 denote a sponge roller and a fixing device, respectively. The fixing device 145 includes a heat roller 146 and a pressure roller 147. A developing unit includes a developing roller 118*a* and the sponge roller 118*c*. The neutralization lamp 200 is disposed on the transfer roller 114 side with respect to the print medium 37. The light emitted from the neutralization lamp 200 passes through a hole formed in a guide, not shown, by which the print medium is guided, and illuminates the photosensitive drum 116. Reference numeral 201 denotes a cleaning roller.

With the aforementioned construction, a photosensitive drum 116 rotates in a direction shown by arrow A and its surface is negatively charged when a negative voltage is applied via a charging roller 117. An LED head 113 illuminates the surface of the photosensitive drum 116 to form an electrostatic latent image on the photosensitive drum 116.

Then, black toner, not shown, negatively charged by the developing roller 118*a* is deposited on the photosensitive drum 116. The electrostatic latent image is developed with the black toner into a black toner image. A print medium 37 passes between the photosensitive drum 116 and a transfer roller 114. When a positive high voltage is applied to the transfer roller 114, the toner image is transferred to the print medium 37.

When the leading edge of the print medium 37 in the form of a transparent sheet reaches between the photosensitive drum 116 and transfer roller 114, the neutralization lamp 200 emits light 200*a*. Since the print medium is made of a transparent material, the light 200*a* emitted from the lamp 200 passes through the print medium to illuminate the surface of the photosensitive drum 116 along the length of the photosensitive drum. As a result, the potential of the photosensitive drum 116 becomes nearly zero volts. Therefore, discharge will not occur between the surface of the photosensitive drum 116 and the print medium 37 when the print medium 37 separates from the photosensitive drum 116, preventing negative surface potential from being generated on the surface of the print medium 37.

Thus, a sufficient amount of toner can be attracted to the print medium 37 eliminating the possibility of poor transfer result occurring.

If the print medium 37 is ordinary paper (non-insulating paper), the light 200*a* does not illuminate the surface of the photosensitive drum 116. This suppresses deterioration of the photosensitive drum 116 resulting from frequent exposure to light. Illuminating the surface of the photosensitive drum with the light from lamp 200 prevents current from flowing from the transfer roller to an area of the drum surface in direct contact with the transfer roller. Therefore, poor transfer of image and deterioration of the photosensitive drum will be prevented even when print media having relatively narrow widths are used.

Third Embodiment

Figure 6:
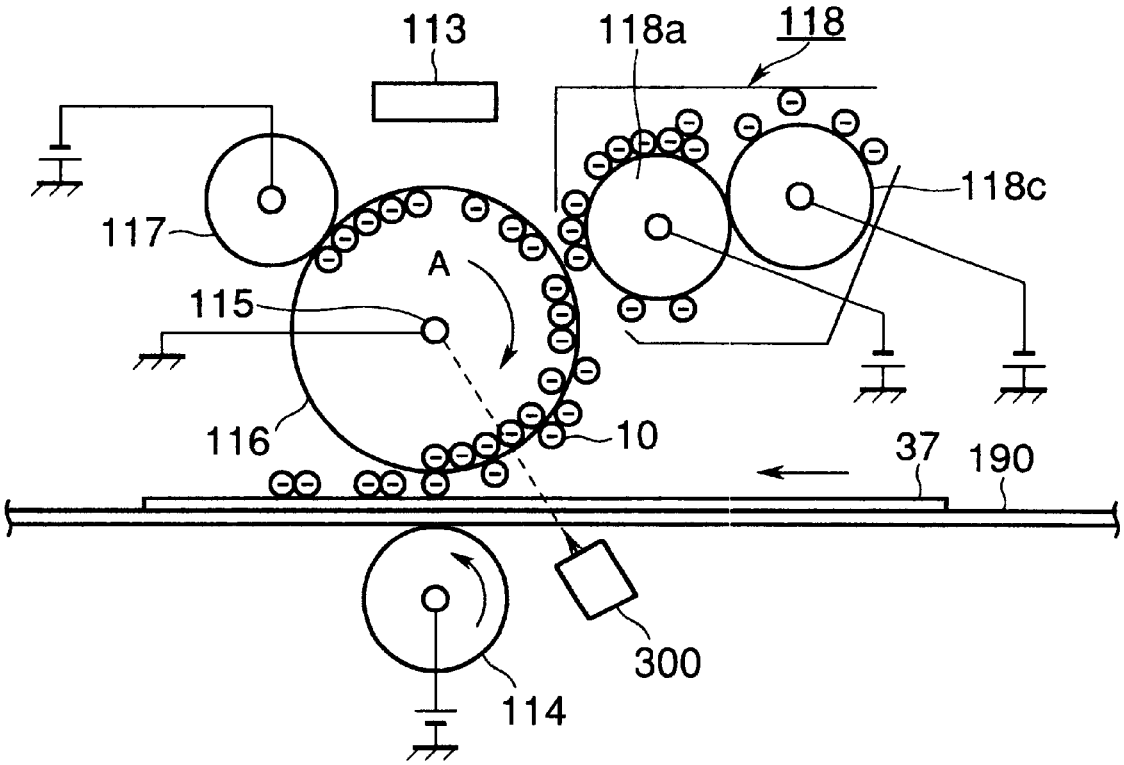
FIG. 6 illustrates a general construction of an image recording apparatus according to a third embodiment.
Figure 7:
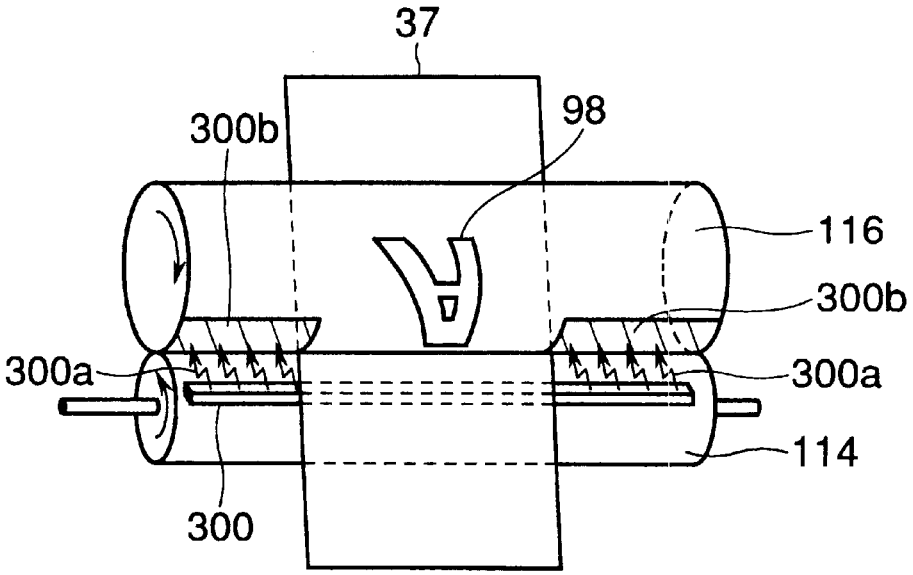
FIG. 7 is a first Figure illustrating the transfer process of the third embodiment.
Figure 8:
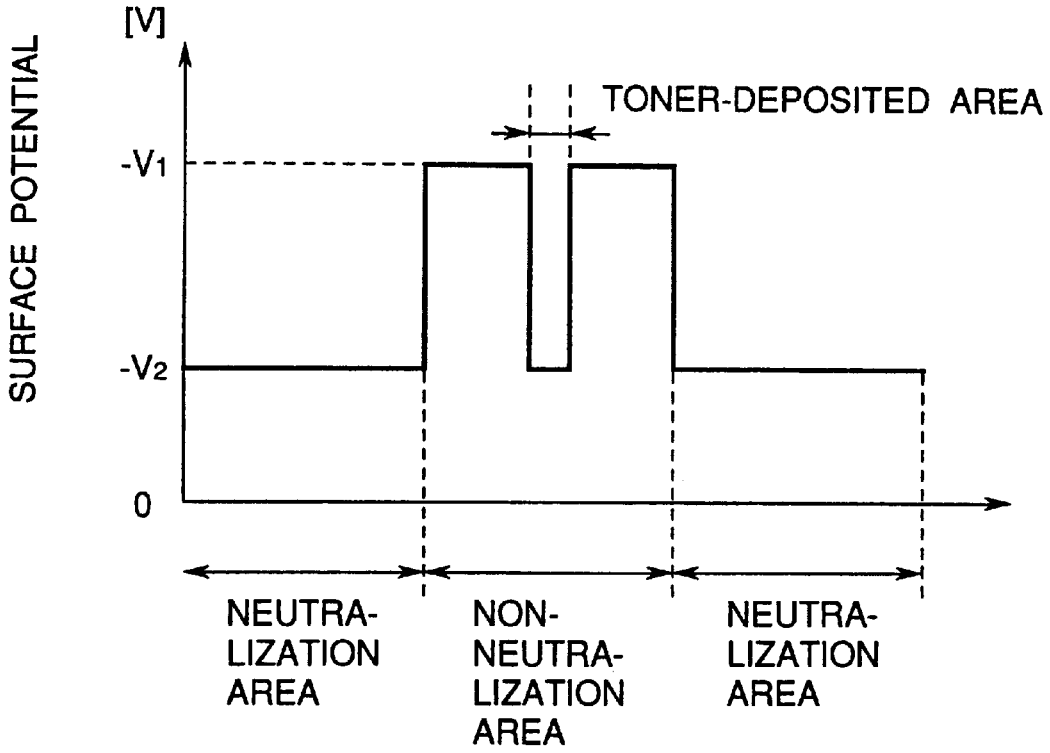
FIG. 8 illustrates the distribution of the charged voltage on the photosensitive drum.
Figure 9:
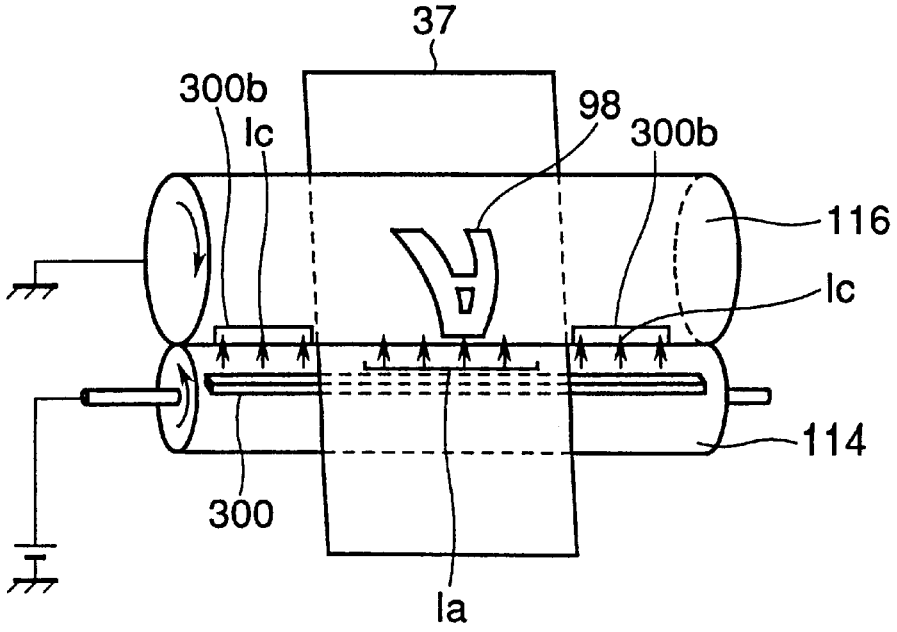
FIG. 9 is a second figure illustrating the transfer process of the third embodiment.

A third embodiment will now be described. FIG. 6 illustrates a general construction of a recording apparatus according to the third embodiment of the invention. The third embodiment may be applicable to both a monochromatic image recording apparatus and color image recording apparatus. FIG. 7 is a first figure illustrating the transfer process of the third embodiment. FIG. 8 illustrates a profile of the potential on the charged photosensitive drum. FIG. 9 is a second figure illustrating the transfer process of the third embodiment.

Reference numeral 118*c* denotes a sponge roller. A carrier belt 190 which transports the print medium is made of a transparent or semitransparent material through which the light emitted from a lamp 300 passes.

With the image recording apparatus of the aforementioned construction, a photosensitive drum 116 is rotated in a direction shown by arrow A and receives a negative voltage via a charging roller 117 so that the surface of the photosensitive drum 116 is negatively charged. An LED head 113 illuminates the photosensitive drum 116 to form an electrostatic latent image thereon.

Then, toner 10 negatively charged by a developing roller 118*a*, is deposited by the developing roller 118*a* of a developing unit 118 to the photosensitive drum 116. The electrostatic latent image is developed with the toner 10 into a black toner image 98. A print medium 37 passes between the photosensitive drum 116 and a transfer roller 114. When a positive high voltage is applied to the transfer roller 114, the toner image 98 is transferred to the print medium 37.

When the leading edge of the print medium 37 reaches between the photosensitive drum 116 and the transfer roller 114, a neutralization lamp 300 emits light 300*a*. The light 300*a* travels through the carrier belt 190 and illuminates selected parts of the surface of the photosensitive drum 116 along the length of the photosensitive drum from behind the print medium 37.

The neutralization lamp 300 is of the same length as the photosensitive drum 116 so that the lamp 300 emits light 300*a* uniformly distributed across the entire length of the photosensitive drum 116. The neutralization lamp 300 is disposed upstream of the transfer roller 114 under the path in which the print medium 37 is transported. The neutralization lamp 300 is positioned so that the print medium 37 is between the photosensitive drum 116 and the neutralization lamp 300. The neutralization lamp 300 is oriented so that the light 300*a* is perpendicular to the rotational shaft 115 of the photosensitive drum 116 and aims at the rotational shaft 115.

As shown in FIG. 7, if the print medium 37 has a width shorter than the lengths of the photosensitive drum 116 and the transfer roller 114, the photosensitive drum 116 is in direct contact with the transfer roller 114 except an area in contact with the print medium 37. As a result, the surface of the photosensitive drum 116 has a neutralization area 300*b* which is illuminated by the light 300*a* and therefore has a decreased surface potential, and a non-neutralization area which is not illuminated by the light 300*a* and therefore the surface potential remains unchanged.

FIG. 8 shows a profile of the surface potential of the photosensitive drum 116. The surface potential of the non-neutralization area is −V1 volts, which is the potential charged by the charging roller 117. The surface potential of the neutralization area 300*b* is −V2 volts, being close to zero volts. The surface potential of the image parts on the photosensitive drum 116 becomes −V2 volts and the toner 10 adheres thereto.

The surfaces of the transfer roller 114 and photosensitive drum 116 are made of materials having high resistance, so that even if some parts of the surface of the photosensitive drum 116 are of a high potential and other parts are of a low potential, charges will not migrate along the surfaces of the transfer roller 114 and the photosensitive drum 116, preventing the toner image 98 from being damaged.

During the transfer operation, the transfer voltage is applied to the transfer roller 114 to cause the negatively charged toner image 98 to be attracted to the print medium 37, and cause the negatively charged surface of the photosensitive drum 116 to be substantially neutralized by positive charges.

With an image recording apparatus of the invention, a transfer current Ia flows in the non-neutralization area and a current Ic flows in the neutralization area 300*b*. However, there are only a limited amount of negative charges in the neutralization area 300*b* due to the fact that the surface potential of the photosensitive drum 116 is discharged to −V2, i.e., nearly zero volts. A less amount of current is needed to produce positive charges which substantially neutralize the negative charges in the neutralization area. A decrease in current Ic alleviates the requirement of current capacity of the transfer power supply.

Moreover, the transfer voltage applied to the transfer roller 114 may be decreased if increased transfer current Ia is not needed. Decreasing the transfer voltage reduces damage to the neutralization area 300*b* on the photosensitive drum 116, preventing deterioration of the photosensitive drum 116 resulting from exposure to light. Thus, in order to address various widths of the print medium 37, the transfer voltage needs to be changed only in a narrow range.

Fourth Embodiment

In the second embodiment, the light 300*a* illuminates the photosensitive drum 116 from behind the print medium 37. This construction requires a hole, not shown, through which the light emitted from the neutralization lamp 300 illuminates the surface of the photosensitive drum. However, paper jam will occur if the leading edge of the print medium 37 such as paper is caught in the hole.

A fourth embodiment is characterized in that paper jam is prevented.

Figure 10:
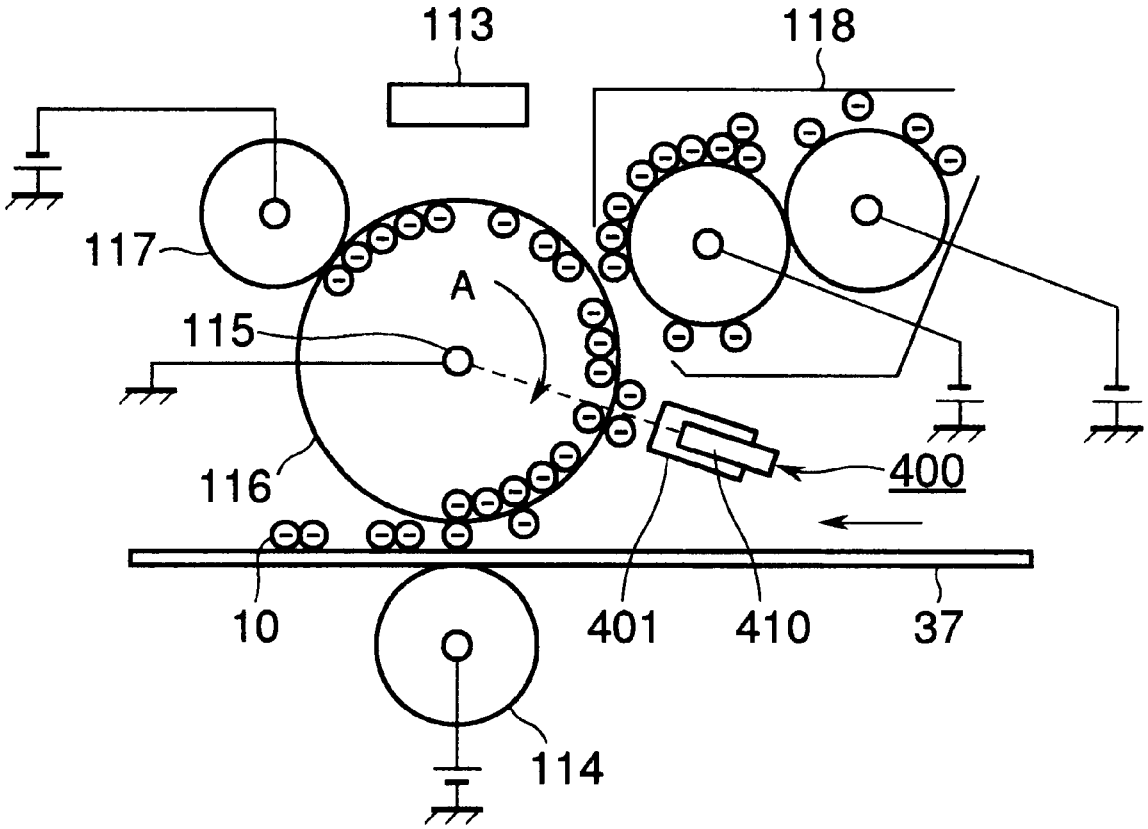
FIG. 10 illustrates a general construction of an image recording apparatus according to a fourth embodiment.
Figure 11:
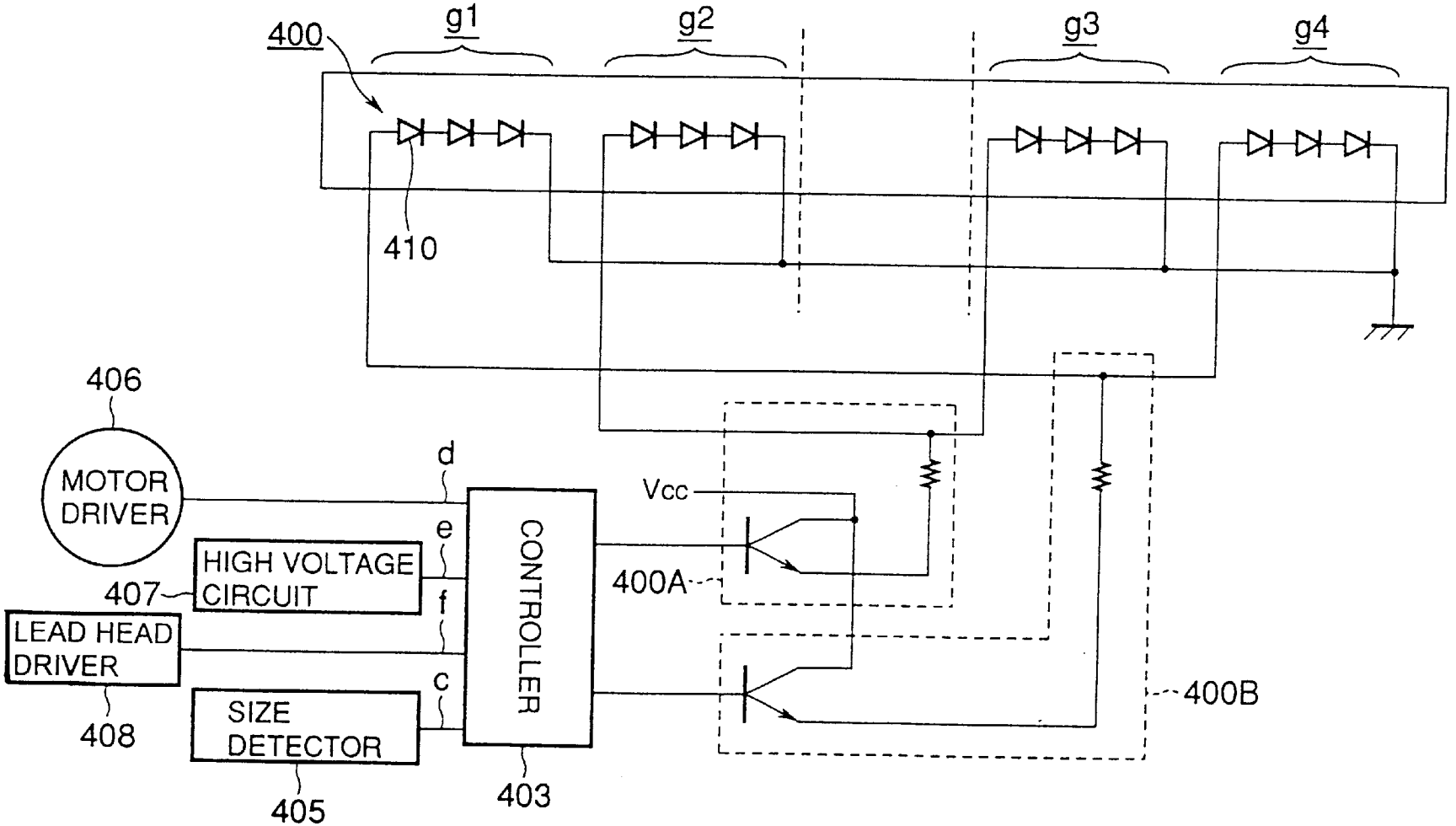
FIG. 11 is a block diagram illustrating an image recording apparatus according to the fourth embodiment.
Figure 12:
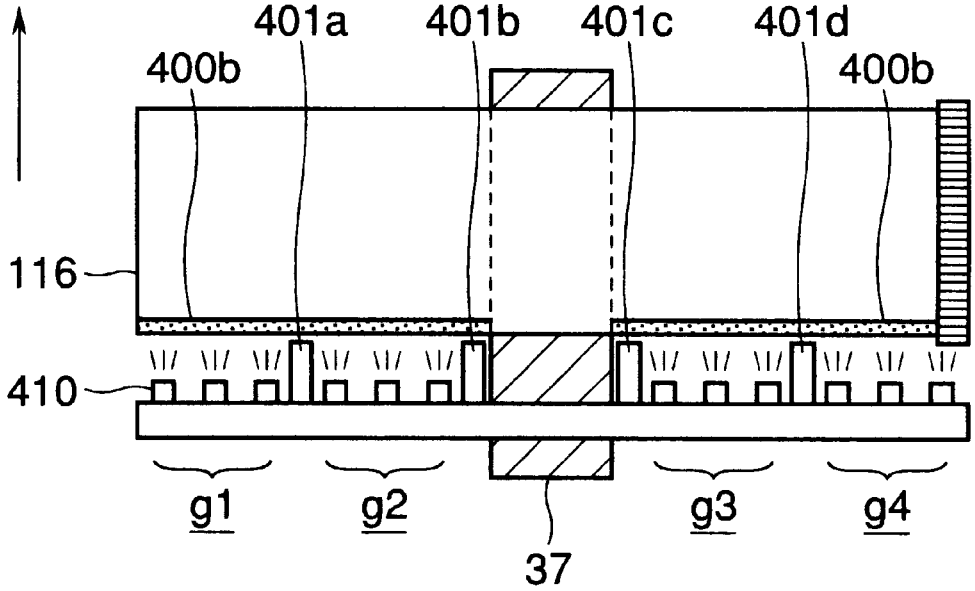
FIG. 12 is a first figure illustrating the transfer process in the image recording apparatus of the fourth embodiment.
Figure 13:
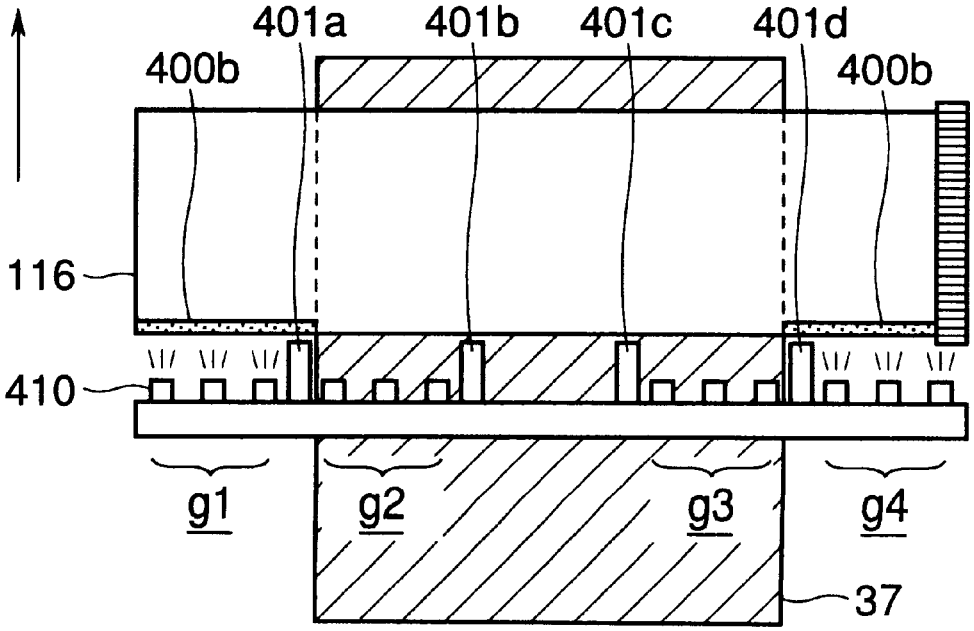
FIG. 13 is a second figure illustrating the transfer process in the image recording apparatus of the fourth embodiment.
Figure 14:
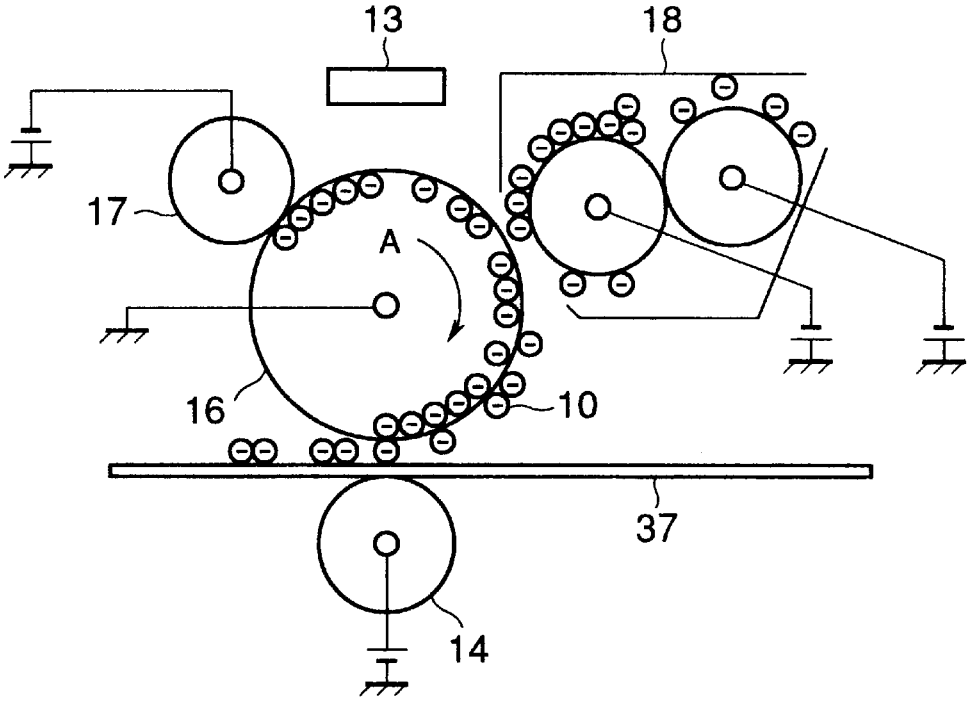
FIG.14 CONVENTIONAL ART
FIG. 14 illustrates a general construction of a conventional image recording apparatus.
Figure 15:
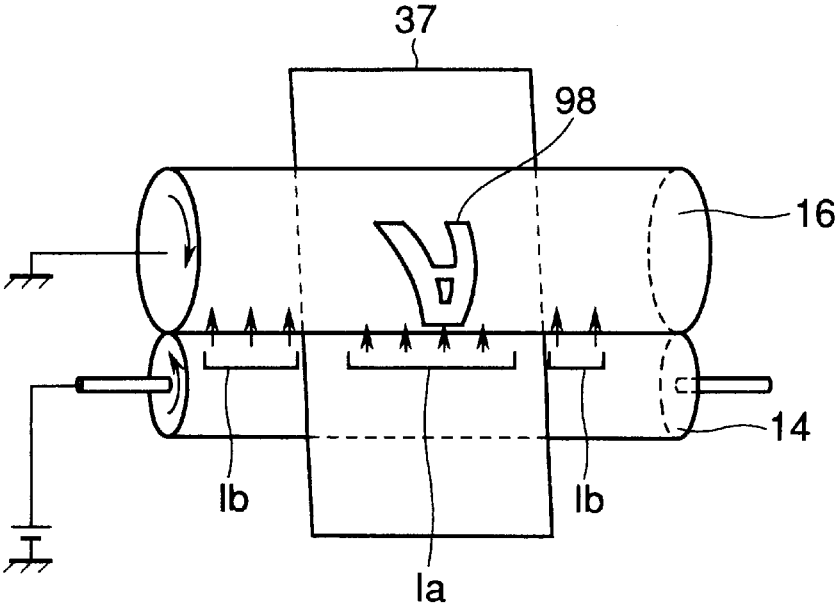
FIG.15 CONVENTIONAL ART
FIG. 15 illustrates the transfer process of the conventional image recording apparatus.

FIG. 10 illustrates a general construction of an image recording apparatus according to the fourth embodiment. FIG. 11 is a block diagram illustrating an image recording apparatus according to the fourth embodiment. FIGS. 12 and 13 are first and second figures illustrating the transfer process in the image recording apparatus. Elements corresponding to those in the third embodiment have been given like reference numerals and description thereof is omitted.

In the fourth embodiment, a neutralization lamp 400 is disposed upstream of the transfer roller 114 and over the path of the print medium 37, and directly opposes the photosensitive drum 116. The neutralization lamp 400 illuminates areas along the length of the photosensitive drum 116 which has been subjected to developing process, forming neutralization areas 400*b* (FIGS. 12 and 13).

The neutralization lamp 400 includes a plurality of light emitting diodes 410 aligned along the length of the photosensitive drum 116. Light blocking walls 401*a*–401*d* are disposed at predetermined intervals along the line of light emitting diodes 410 so that the light emitting diodes 410 are divided into four groups g1–g4 with the light blocking walls 401*a*–401*d* disposed between adjacent groups.

Each group includes a predetermined number of light emitting diodes 410. A neutralization lamp driver 400A drives the light emitting diodes 410 in the groups g2 and g3. A neutralization lamp driver 400B drives the light emitting diodes 410 in the groups g1 and g4. A size detector 405 detects the width of the print medium 37. A motor driver 406 drives the photosensitive drum 116, the charging roller 117, the developing unit 118, and the transfer roller 114 in rotation. A high voltage circuit 407 applies high voltages to the charging roller 117, developing unit 118, and transfer roller 114. A LED head driver 408 controls the LED head 113. A controller 403 controls the overall operation of the image recording apparatus.

The light emitting diodes 410 are disposed outside of an area that is occupied by a minimum width of the print medium 37. The light emitting diodes 410 are selectively driven on a group basis so that only diodes outside of the area occupied by the medium 37 light up.

When the print medium 37 is of the minimum width as shown in FIG. 12, the light emitting diodes 410 in the groups g1 to g4 light up. When the print medium 37 is of a middle width as shown in FIG. 13, the light emitting diodes 410 in the groups g1 and g4 light up.

The light emitting diodes 410 of each group g1–g4 oppose corresponding parts on the surface of the photosensitive drum 116 and illuminate the corresponding surface of the photosensitive drum 116 so that the charged surface of the photosensitive drum 116 is substantially neutralized. The light blocking walls 401*a*–401*d* serves to block light so that an area on the photosensitive drum opposing each group is not illuminated by adjacent groups. A pair of light blocking walls 401*b* and 401*c* is disposed at a laterally centered position, spaced apart from each other by a distance slightly longer than the minimum width of the print medium 37. The light blocking walls 401*b* and 401*c* blocks light from groups g2 and g3 to ensure that an area of the photosensitive drum opposing the print medium 37 having the minimum width is not illuminated.

With the aforementioned construction, upon receiving a print initiation command from a controller or host computer, not shown, the controller 403 starts to print. The controller 403 also receives a detection signal indicative of the width of the print medium 37 from the size detector 405.

The controller 403 controls the motor driver 406 to feed the print medium 37 from a tray or manual feeding tray, not shown, and sends a voltage application command to the high voltage circuit 407 which in turn supplies high voltages to the charging roller 117, rollers in the developing unit 118, and transfer roller 114.

The photosensitive drum 116 is driven in rotation by the motor driver 406 and the surface of the photosensitive drum 116 is uniformly charged by the charging roller 117.

The print medium 37 fed from the medium tray or manual feeding tray is transported by a feeding roller, not shown, till it is pulled in between the photosensitive drum 116 and transfer roller 114.

If the detection signal from the size detector 405 indicates that the print medium 37 has the maximum width, the light emitting diodes 410 will not light up at all during printing.

If the print medium 37 has the minimum width, the controller 403 outputs a command to the neutralization lamp drivers 400A and 400B at the same time as the motor driver 406 drives the photosensitive drum 116 into rotation, so that as shown in FIG. 12, the respective light emitting diodes 410 of the groups g1 to g4 light up to substantially neutralize the negative charges in the neutralization area 400*b*.

The light blocking walls 401*b*–401*c* block the light emitted from the LED arrays of adjacent groups, preventing the light from entering the area on the photosensitive drum 116 that opposes the print medium 37.

If the print medium 37 is of a middle width, the controller 403 controls the motor driver 406 to drive the photosensitive drum 116 into rotation while also outputting a command to the neutralization lamp driver 400B so that the respective light emitting diodes 410 of the groups g1 and g4 to light up to substantially neutralize the neutralization area 400*b* on the photosensitive drum 116.

The light blocking walls 401*a* and 401*d* block the light emitted from the light emitting diodes 410, preventing the light from entering the area on the photosensitive drum 116 that opposes the print medium 37. In this manner, the light of the neutralization lamp 400 is adapted to illuminate the surface area of the photosensitive drum 116 in accordance with the width of the print medium 37, so that areas on the photosensitive drum 116 outside of the area opposing the print medium 37 are substantially neutralized to nearly zero volts. This eliminates the possibility of discharge occurring between the surface of the photosensitive drum 116 and the surface of the print medium 37 when the print medium 37 passes between tile photosensitive drum 116 and the transfer roller 114, and prevents a negative surface potential from increasing on the print medium 37.

As a result, the toner 10 may be attracted sufficiently to the print medium 37 for good transfer result.

There is only a limited amount of negative charges due to the fact that the surface potential on the neutralization area 400*b* becomes nearly zero volts. This implies that a less amount of current is needed for generating positive charges which substantially neutralize the negative charges on the photosensitive drum 116. Therefore, the transfer current may be increased accordingly.

Further, the transfer voltage applied to the transfer roller 114 can be decreased while maintaining the same transfer result, so that the neutralization area 400*b* on the photosensitive drum 116 is less damaged. Disposing the neutralization lamp 400 to directly oppose the photosensitive drum 116 eliminates the need for forming, for example, a hole in the path of the print medium 37. Thus, this construction prevents the print medium 37 from jamming.

If the print medium 37 is a transparent sheet, when the leading edge of the print medium 37 reaches between the photosensitive drum 116 and transfer roller 114, the light emitting diodes 410 of the neutralization lamp 400 are caused to light up. The light emitting diodes 410 illuminate the surface of the photosensitive drum 116 so that the surface of the photosensitive drum 116 becomes nearly zero volts. Thus, discharge will not take place between the surfaces of the photosensitive drum 116 and print medium 37, preventing a negative surface potential from developing on the surface of the print medium 37.

In the fourth embodiment, while light emitting diodes are not provided light emitting diodes between the light blocking walls 401*b* and 401*c*, light emitting diodes may also be provided between the light blocking walls 401*b* and 401*c*, so that the light emitted from the light emitting diodes illuminate the entirety of the surface of the photosensitive drum, thereby neutralizing the charged surface of the photosensitive drum along the length thereof when an insulating sheet is used.

As a result, the toner 10 may be attracted sufficiently to the print medium 37 for good transfer result.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

In the first and third embodiments, while the carrier belt carries the print medium from one print mechanism to another, the printing mechanisms P1–P4 may be arranged close to each other so that the print medium may be transported from one print mechanism to another by means of rollers and/or guides. If transparent or semitransparent rollers and guides are employed in the third embodiment, the light emitted from the neutralization lamp may illuminate the surface of the photosensitive drum through such rollers and guides.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image recording apparatus in which an electrostatic latent image is formed on a charged surface of a rotating photosensitive drum, the electrostatic latent image being developed by a developing unit and subsequently transferred by a transferring device to a print medium, the apparatus comprising:

a neutralizing device for neutralizing the charged surface of the photosensitive drum at an area on the surface of the drum, the neutralizing device being disposed downstream of the developing unit and upstream of the transferring device with respect to rotation of the photosensitive drum; and a controller for controlling said neutralizing device so that said neutralizing device neutralizes the charged surface of the photosensitive drum before the latent image is transferred to a print medium of a first kind, and does not neutralize the charged surface of the photosensitive drum before the latent image is transferred to a print medium of a second kind.

2. The image recording apparatus according to claim 1, wherein said neutralizing device emits light that illuminates a selected part of said charged surface of said photosensitive drum to substantially neutralize said selected part.

3. The image recording apparatus according to claim 2, wherein said neutralizing device is disposed upstream of said transferring device with respect to rotation of said photosensitive drum and directly opposes said charged surface of said photosensitive drum.

4. The image recording apparatus according to claim 3, wherein said neutralizing device includes a plurality of light emitting diodes aligned in a direction parallel to said charged surface of said photosensitive drum, said light emitting diodes being selectively turned on to illuminate said selected part.

5. The image recording apparatus according to claim 1, wherein said neutralizing device substantially neutralizes an entirety of said charged surface of said photosensitive drum.

6. The image recording apparatus according to claim 5, wherein said neutralizing device comprises a lamp which directly opposes said photosensitive drum and illuminates said charged surface of said photosensitive drum.

7. The image recording apparatus according to claim 6, wherein said neutralizing device emits light that illuminates said charged surface of said photosensitive drum to substantially neutralize said charged surface, and the print medium is made of an insulating material.

8. An image recording apparatus in which an electrostatic latent image is formed on a charged surface of a rotating photosensitive drum, the electrostatic latent image being developed by a developing unit into a toner image, the toner image being transferred by a transferring device to a print medium, the apparatus compromising:

a neutralizing device for neutralizing the charged surface of the photosensitive drum from behind the print medium; and a controller for controlling said neutralizing device so that said neutralizing device neutralizes an area of the charged surface of the photosensitive drum not opposing the print medium, the area being between the developing unit and the transferring device with respect to rotation of the drum.

9. The image recording apparatus according to claim 8, wherein said neutralizing device emits light from behind the print medium to illuminate the area to substantially neutralize the area.

10. The image recording apparatus according to claim 9, wherein said neutralizing device comprises a lamp.

11. The image recording apparatus according to claim 10 wherein said electrostatic latent image is an image of color.

12. An image recording apparatus in which an electrostatic latent image is formed on a charged surface of a rotating photosensitive drum, the electrostatic latent image being developed by a developing unit and subsequently transferred by a transferring device to a print medium, the apparatus comprising:

a neutralizing device for neutralizing the charged surface of the photosensitive drum at an area on the surface of the drum, the neutralizing device being disposed downstream of the developing unit and upstream of the transferring device with respect to rotation of the photosensitive drum to directly oppose said charged surface of said photosensitive drum; and a controller for controlling the neutralizing device according to the characteristics of the print medium so that the neutralizing device neutralizes a selected part of said charged surface of said photosensitive drum at an area outside of said charged surface of said photosensitive drum opposing the print medium according to a width of the print medium, said neutralizing device emitting light that illuminates said selected part of said charged surface of said photosensitive drum to substantially neutralize said selected part, said neutralizing device including a plurality of light emitting diodes aligned in a direction parallel to said charged surface of said photosensitive drum, said light emitting diodes being selectively turned on to illuminate said selected part, said plurality of light emitting diodes being divided into a plurality of groups with light blocking walls disposed between adjacent diode groups, the diode groups being selectively turned on according to a width of the print medium.

13. An image recording apparatus in which an electrostatic latent image is formed on a charged surface of a rotating photosensitive drum, the electrostatic latent image being developed by a developing unit and subsequently transferred by a transferring device to a print medium, the apparatus comprising:

a neutralizing device for substantially neutralizing a selected part of the charged surface of the photosensitive drum at an area on the surface of the drum according to the characteristics of the print medium, the neutralizing device being disposed downstream of the developing unit and upstream of the transferring device with respect to rotation of the photosensitive drum, the neutralizing device emitting light that illuminates the selected part of the charged surface of the photosensitive drum to substantially neutralize the selected part, and a controller for controlling the neutralizing device according to the characteristics of the print medium, the neutralizing device emitting light to the charged surface of the photosensitive drum from behind the print medium.

14. The image recording apparatus according to claim 13, wherein said neutralizing device is a lamp which illuminates said charged surface of said photosensitive drum.

15. The image recording apparatus according to claim 14, wherein said electrostatic latent image is an image of a color and the print medium is transported on a belt through which said light travels.

16. An image recording apparatus in which an electrostatic latent image is formed on a charged surface of a rotating photosensitive drum, the electrostatic latent image being developed by a developing unit and subsequently transferred by a transferring device to a print medium, the apparatus comprising:

a neutralizing device for neutralizing the charged surface of the photosensitive drum at an area on the surface of the drum, the neutralizing device being disposed downstream of the developing unit and upstream of the transferring device with respect to rotation of the photosensitive drum; and a controller for controlling the neutralizing device so that the neutralizing device neutralizes the charged surface of the photosensitive drum before the latent image is transferred to a print medium if the print medium is of a predetermined kind.

17. The image recording apparatus according to claim 16, further including a detector which outputs a detection signal indicative of the predetermined kind of the print medium.

18. The image recording apparatus according to claim 16, wherein said neutralizing device is a lamp which directly opposes said photosensitive drum and illuminates said charged surface of said photosensitive drum.

19. The image recording apparatus according to claim 16, wherein the predetermined kind is an insulating sheet.

* * * * *